US010213008B2

(12) United States Patent
Weaver, Jr. et al.

(10) Patent No.: US 10,213,008 B2
(45) Date of Patent: Feb. 26, 2019

(54) BALLISTIC BACKPACK

(71) Applicants: Ronald E. Weaver, Jr., Long Beach, CA (US); Donna Webber, Tolland, CT (US)

(72) Inventors: Ronald E. Weaver, Jr., Long Beach, CA (US); Donna Webber, Tolland, CT (US)

( * ) Notice: Subject to any disclaimer, the term of this patent is extended or adjusted under 35 U.S.C. 154(b) by 0 days.

(21) Appl. No.: 15/959,497

(22) Filed: Apr. 23, 2018

(65) Prior Publication Data

US 2018/0303226 A1 Oct. 25, 2018

Related U.S. Application Data

(60) Provisional application No. 62/488,915, filed on Apr. 24, 2017.

(51) Int. Cl.

| | |
|---|---|
| ***A45F 3/06*** | (2006.01) |
| ***A45F 4/02*** | (2006.01) |
| ***F41H 1/02*** | (2006.01) |
| ***F41H 5/013*** | (2006.01) |
| *A45F 3/04* | (2006.01) |
| *A45F 3/00* | (2006.01) |

(52) U.S. Cl.

CPC ..... *A45F 3/06* (2013.01); *A45F 4/02* (2013.01); *F41H 1/02* (2013.01); *F41H 5/013* (2013.01); *A45F 2003/003* (2013.01); *A45F 2003/045* (2013.01)

(58) Field of Classification Search

CPC ..... A45F 3/04; A45F 3/06; A45F 4/02; A45F 2003/045; F41H 1/02

USPC ..... 224/153, 156

See application file for complete search history.

(56) References Cited

U.S. PATENT DOCUMENTS

| | | | | |
|---|---|---|---|---|
| 4,830,245 | A * | 5/1989 | Arakaki | A45F 3/04 2/2.5 |
| 6,161,738 | A * | 12/2000 | Norris | A45C 9/00 109/49.5 |
| 6,419,132 | B1 * | 7/2002 | Reed | A45C 15/00 109/49.5 |
| 6,685,071 | B2 * | 2/2004 | Prather | A45C 15/00 2/2.5 |
| 9,820,558 | B1 * | 11/2017 | de Geus | A45F 4/02 |
| 10,098,441 | B1 * | 10/2018 | Holloman | A45F 3/047 |
| 2007/0266469 | A1 * | 11/2007 | Blakeley | F41C 33/06 2/2.5 |

(Continued)

*Primary Examiner* — Justin Larson

(74) *Attorney, Agent, or Firm* — Bennet K. Langlotz; Langlotz Patent & Trademark Works, LLC

(57) ABSTRACT

Ballistic backpacks have a pouch having a back panel defining a compartment having a pouch lower edge, shoulder straps connected to the pouch, a closure flap connected to the compartment with a flap lower edge connected to the pouch at the pouch lower edge, the closure flap being movable between a closed position in which the closure flap extends up from the pouch lower edge and encloses the pouch, and a deployed position in which the closure flap depends downward from the pouch lower edge, a first ballistic panel connected to the back panel and having a first panel edge proximate the lower pouch edge, a second ballistic panel connected to the closure flap with a second panel edge proximate the lower flap edge at a level above the pouch lower edge, such that when the closure flap is in the deployed position, the first and second ballistic panels overlap.

17 Claims, 7 Drawing Sheets

(56) References Cited

U.S. PATENT DOCUMENTS

| | | | | |
|---|---|---|---|---|
| 2007/0295772 | A1* | 12/2007 | Woodmansee | A45F 3/047 224/576 |
| 2009/0014490 | A1* | 1/2009 | Bradley | A45C 13/008 224/576 |
| 2015/0048133 | A1* | 2/2015 | Alba | F41H 5/08 224/576 |
| 2016/0360864 | A1* | 12/2016 | Drake | A41D 1/04 |
| 2017/0102214 | A1* | 4/2017 | Wright | F41H 1/02 |
| 2017/0276457 | A1* | 9/2017 | Chapman | A45F 3/04 |
| 2017/0318941 | A1* | 11/2017 | Vaughan | A41D 1/04 |
| 2017/0332768 | A1* | 11/2017 | Fraile Nuez | A45F 3/04 |
| 2018/0003466 | A1* | 1/2018 | Rose | F41H 1/02 |

* cited by examiner

BALLISTIC BACKPACK

FIELD OF THE INVENTION

The present invention relates to body armor, and more particularly to a ballistic backpack that can be rapidly configured into body armor.

BACKGROUND OF THE INVENTION

Ballistic backpacks are fabric sacks carried on a wearer's back that are secured by two straps that go over the wearer's shoulders. Backpacks are useful because they enable the wearer to carry heavy loads for prolonged periods and because they leave the wearer's hands free.

Various types of ballistic vests are desirable for protecting law enforcement and military personnel from projectiles fired from firearms and from shrapnel from explosions. Ballistic vests are worn on the torso and are used with metal or ceramic plates to provide additional protection from rifle rounds as well as resistance to stab and/attacks from knives and bayonets. Ballistic vests may also include shoulder and side protection armor components. Although ballistic vests can be configured to carry limited amounts of cargo in pouches and leave the wearer's hands free, they have very limited cargo carrying capacity compared to a backpack. Furthermore, when the ballistic backpack of the current invention is in the folded condition, the ability of the ballistic backpack to rapidly configure into body armor is concealed. In contrast, the protective nature of a ballistic vest and its association with law enforcement and military personnel are readily apparent to an observer.

Therefore, a need exists for a new and improved ballistic backpack that can be rapidly configured into body armor. In this regard, the various embodiments of the present invention substantially fulfill at least some of these needs. In this respect, the ballistic backpack according to the present invention substantially departs from the conventional concepts and designs of the prior art, and in doing so provides an apparatus primarily developed for the purpose of enabling rapid configuration into body armor.

SUMMARY OF THE INVENTION

The present invention provides an improved ballistic backpack, and overcomes the above-mentioned disadvantages and drawbacks of the prior art. As such, the general purpose of the present invention, which will be described subsequently in greater detail, is to provide an improved ballistic backpack that has all the advantages of the prior art mentioned above.

To attain this, the preferred embodiment of the present invention essentially comprises a pouch having a back panel defining a compartment having a pouch lower edge, shoulder straps connected to the pouch, a closure flap connected to the compartment and having a flap lower edge connected to the pouch at the pouch lower edge, the closure flap being movable between a closed position in which the closure flap extends up from the pouch lower edge and encloses the pouch, and a deployed position in which the closure flap depends downward from the pouch lower edge, a first ballistic panel connected to the back panel and having a first panel edge proximate the lower pouch edge, a second ballistic panel connected to the closure flap and having a second panel edge proximate the lower flap edge, and the flap lower edge being at a level above the pouch lower edge, such that when the closure flap is in the deployed position, the first and second ballistic panels overlap. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
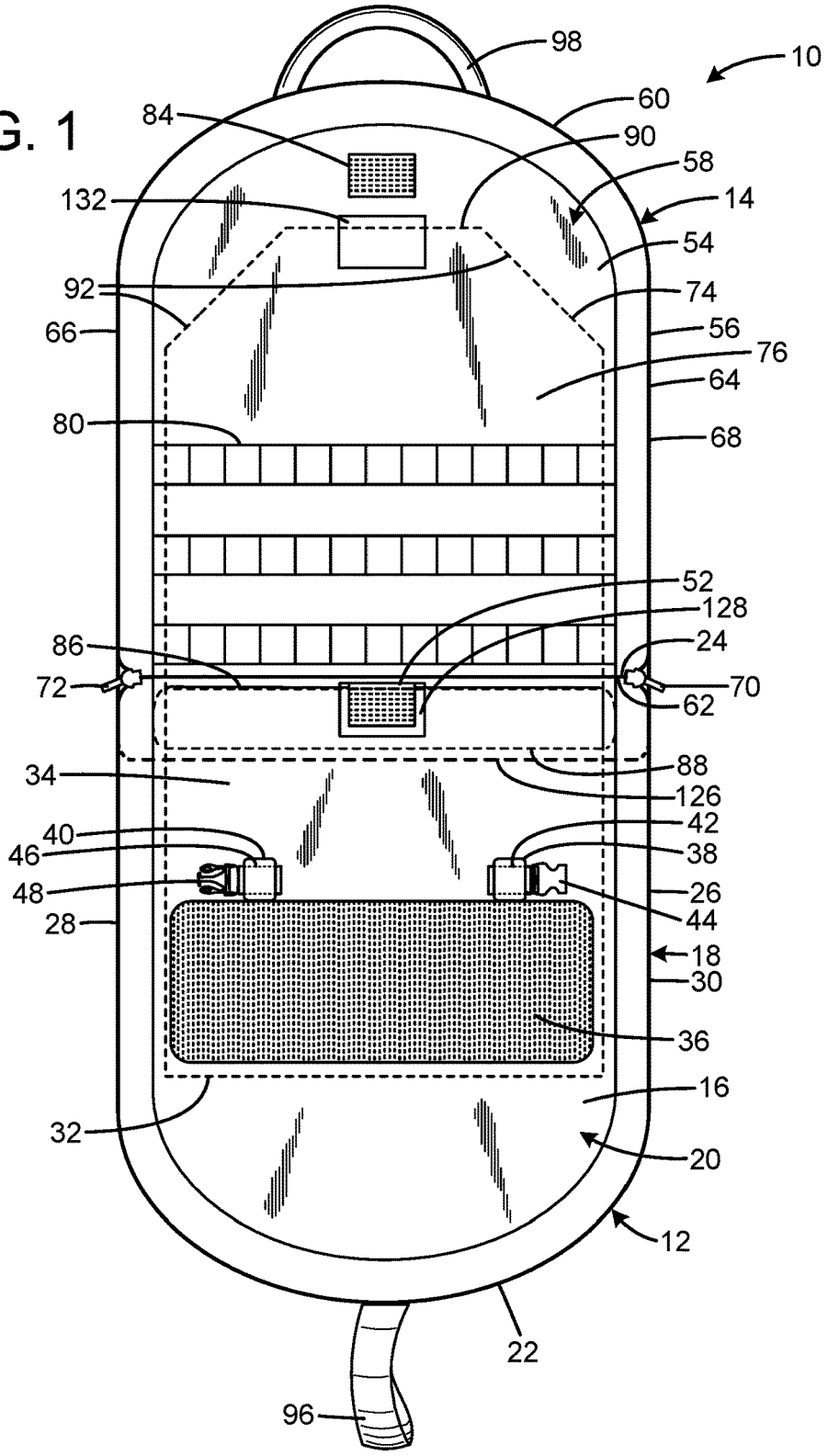
FIG. 1 is a front view of the current embodiment of the ballistic backpack constructed in accordance with the principles of the present invention in the unfolded condition.
Figure 2:
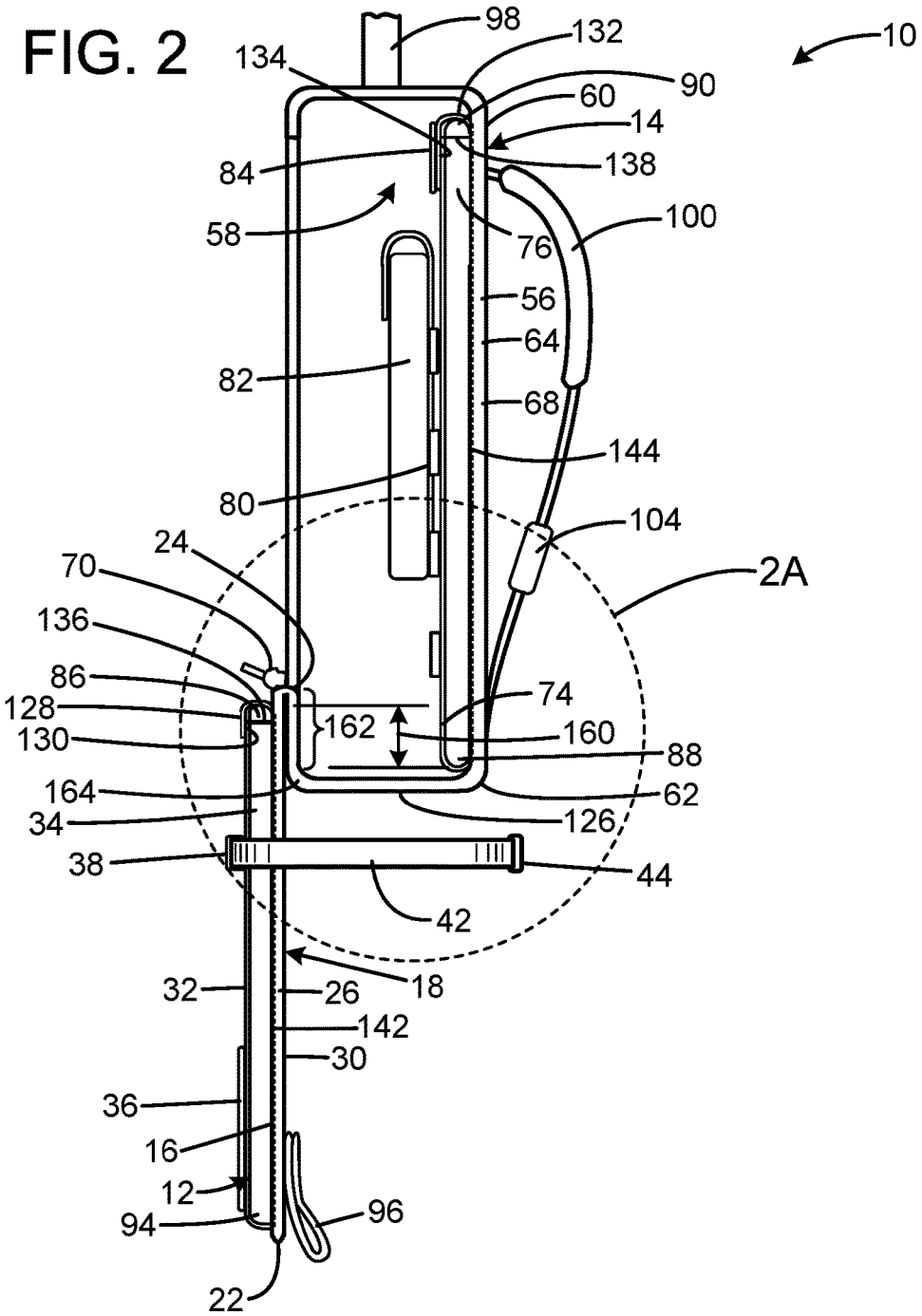
FIG. 2 is a side sectional view of the ballistic backpack of FIG. 1 in the unfolded condition.
Figure 2A:
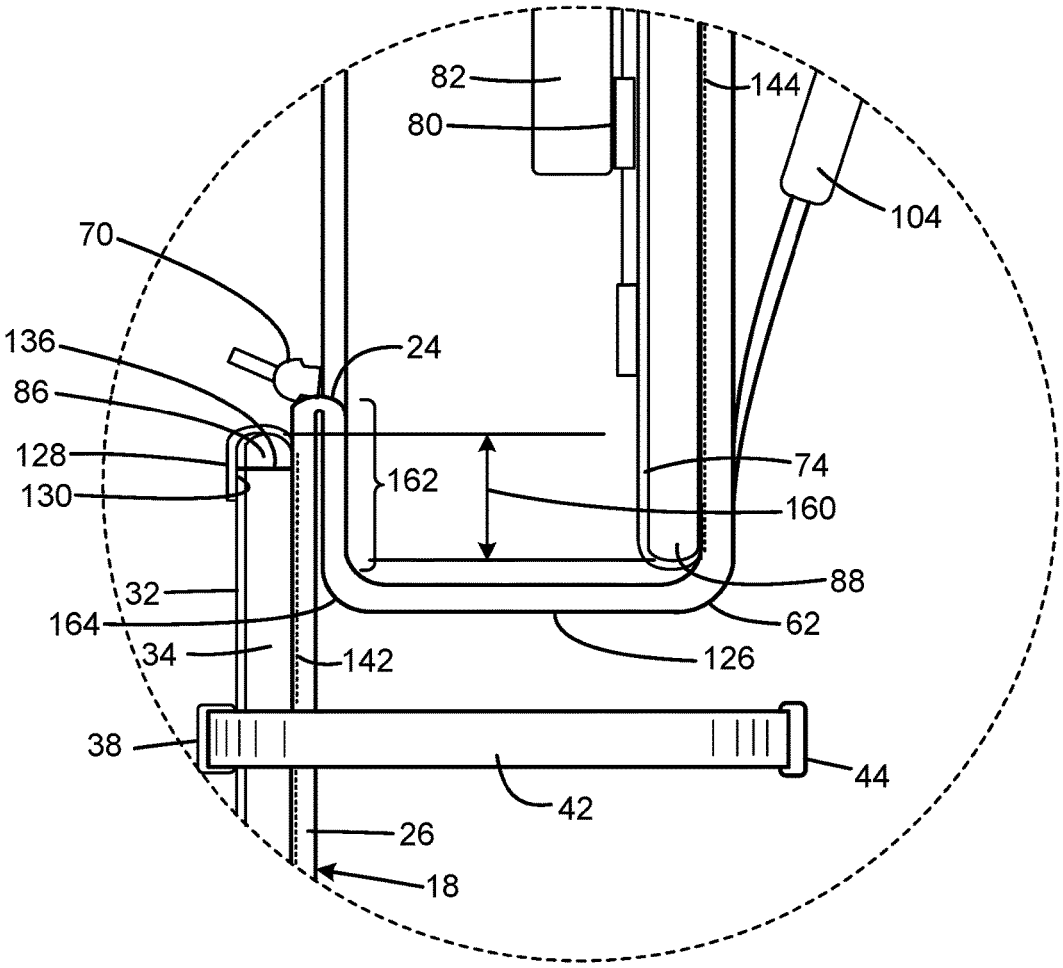
FIG. 2A is an enlarged view of circled area 2A of FIG. 2.
Figure 3:
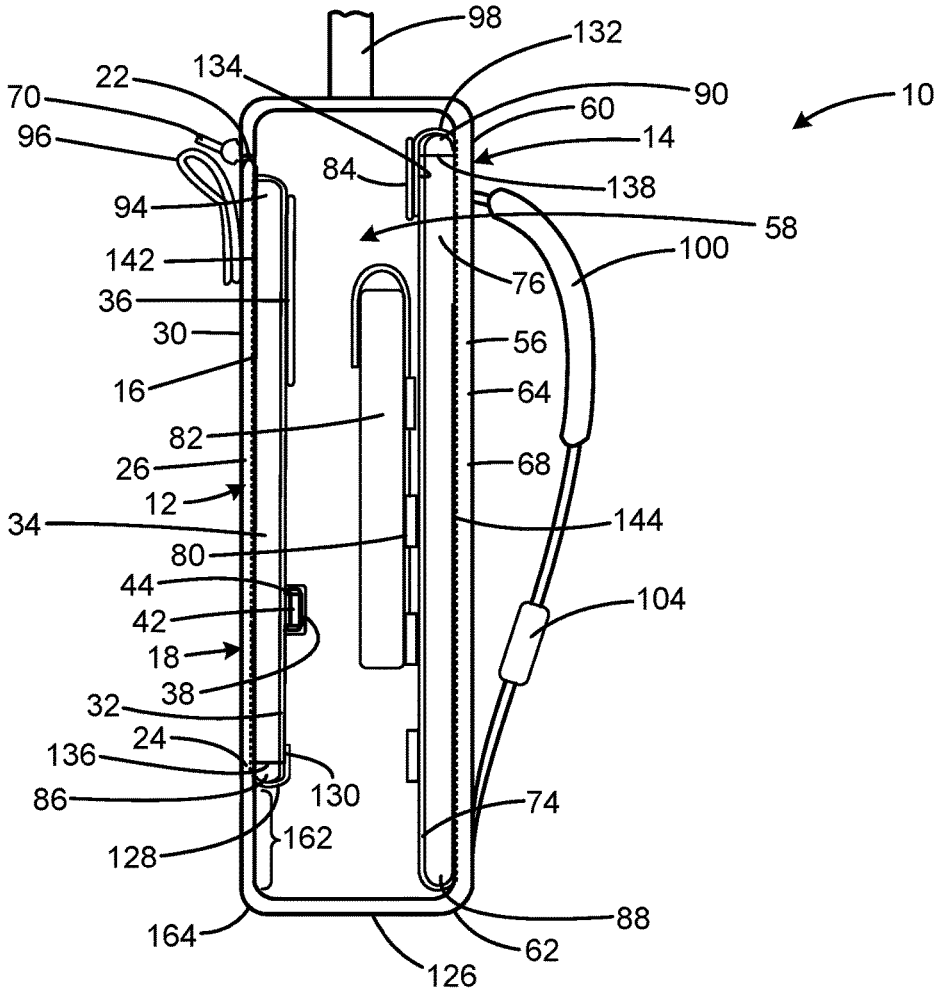
FIG. 3 is a side sectional view of the ballistic backpack of FIG. 1 in the folded condition.
Figure 4:
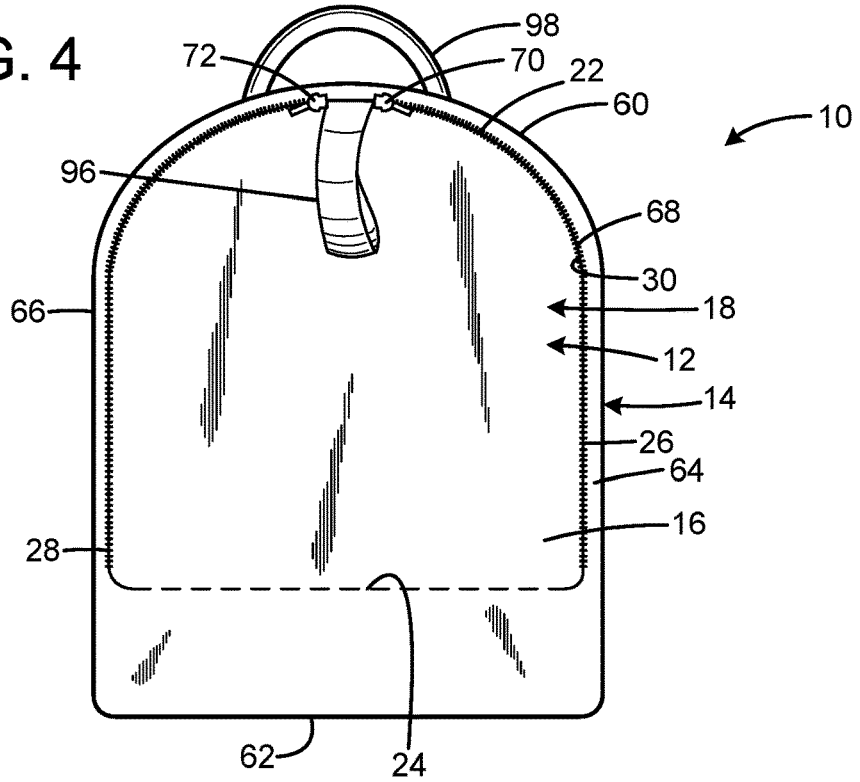
FIG. 4 is a front view of the ballistic backpack of FIG. 1 in the folded condition.
Figure 5:
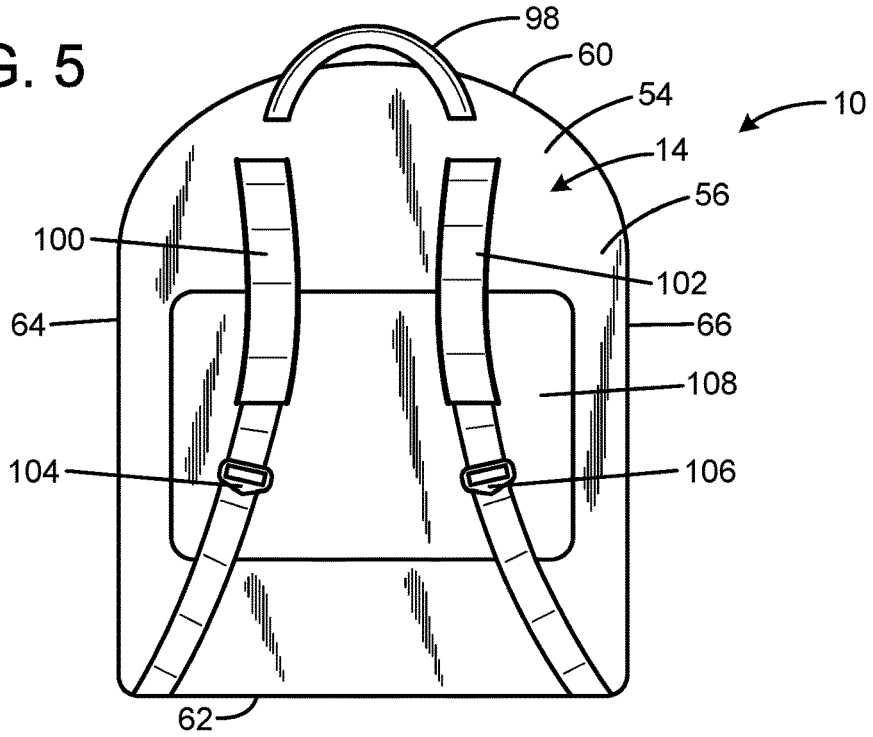
FIG. 5 is a rear view of the ballistic backpack of FIG. 1 in the folded condition.
Figure 6:
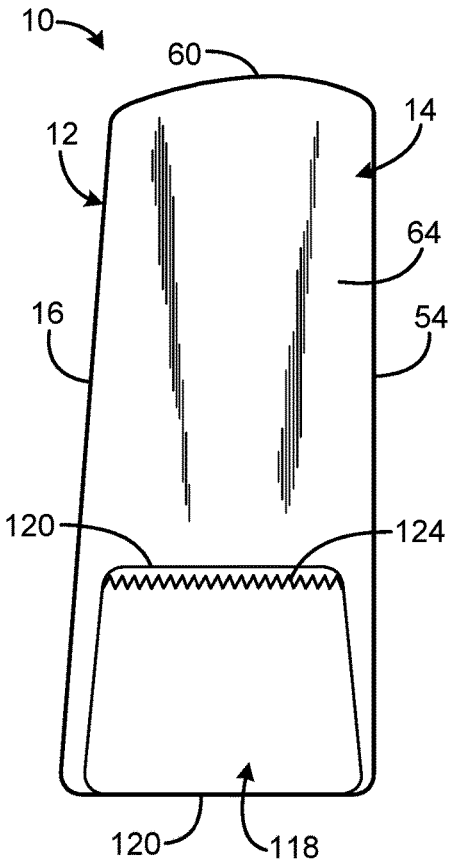
FIG. 6 is a left side view of the ballistic backpack of FIG. 1 in the folded condition.
Figure 7:
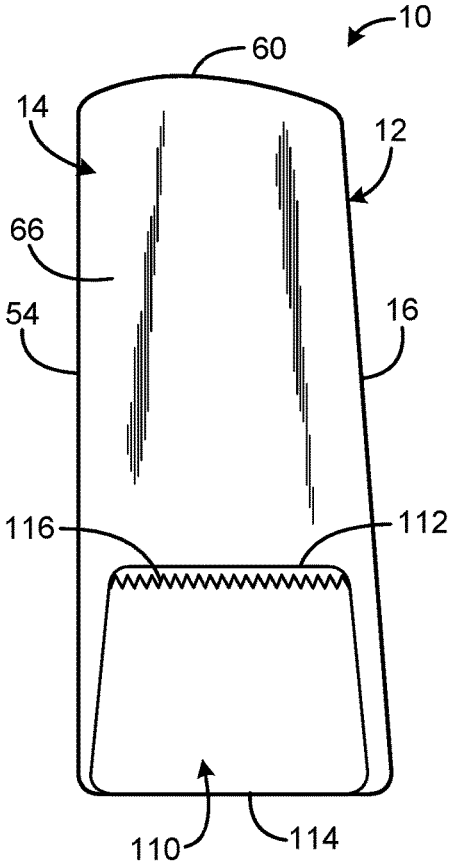
FIG. 7 is a right side view of the ballistic backpack of FIG. 1 in the folded condition.
Figure 8:
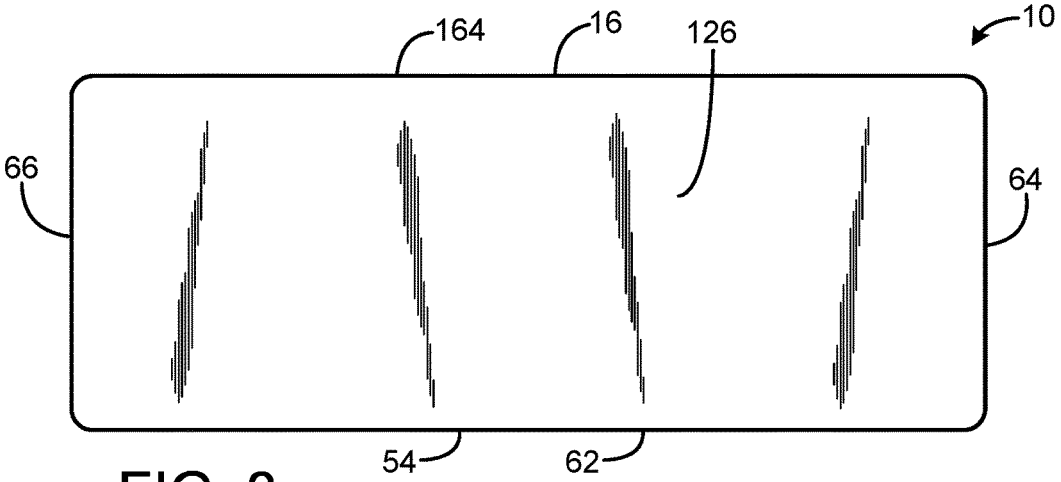
FIG. 8 is a bottom view of the ballistic backpack of FIG. 1 in the folded condition.

An embodiment of the ballistic backpack of the present invention is shown and generally designated by the reference numeral 10.

FIGS. 1-2A and 10 illustrate the improved ballistic backpack 10 of the present invention. More particularly, the ballistic backpack is a loadbearing armor plate carrier that is shown in the unfolded condition/deployed position serving as a fold down ballistic shield to protect the front torso 146 of a wearer 148 (shown in FIG. 10). The backpack has a front portion 12 having a bottom 164 connected to a rear portion 14 to form a pouch. The front portion has a front wall panel/closure flap 16 having an exterior 18, an interior 20, a top 22, a bottom/flap lower edge 24, a right edge 26, and a left edge 28. A front zipper half 30 extends around the right edge, top, and left edge to the bottom/flap lower edge of the front wall panel/closure flap. The bottom of the front wall/closure flap is connected to the bottom of the front portion by a lower front portion 162. The interior includes a front pocket/carrier 32 directly attached to the pouch and having a bottom end 136 that defines an enclosure that receives a ballistic plate/panel element 34. The ballistic plate is sewn (stitch line 142) in the front pocket to connect the ballistic plate to the front wall panel and is held securely by an elastic strap 128 with a hook and loop fastener 130 on the end so the ballistic plate can be removed and replaced. A portion of the front pocket is covered by a first hook and loop fastener area 36. The first hook and loop fastener area can be used to secure any desired item having a hook and loop fastener so the item will not fall out of the ballistic backpack when the ballistic backpack is in the deployed position. It is currently contemplated that identification insignia, such as a POLICE identification tape 150 (shown in FIG. 10), could be secured to the first hook and loop fastener area so the identification indicia are displayed upright when the closure flap is in the deployed position.

The front pocket 32 on the front wall/closure flap 16 includes a right retainer loop 38 and a left retainer loop 40. A right waist strap 42 having the female portion of a side release buckle 44 is attached to the front pocket. A left waist strap 46 having the male portion of a side release buckle 48 is attached to the front pocket. When not in use, the right and left waist straps can be rolled up and releasably retained by the right and left retainer loops. When the ballistic backpack is in the deployed position, the wearer 148 can withdraw the right and left waist straps from the right and left retainer loops to enable the side release buckle portions to be buckled behind the wearer's back 152 to encompass the wearer's body 154, thereby holding the front wall in place in front of the wearer when the front ballistic plate/second ballistic panel 34 is in the deployed position. Alternatively, the right and left waist strap and side release buckle portions could serve as attachment points for a separate waist belt encompassing the wearer's body. The front pocket also defines a second hook and loop fastener area 52. The second hook and loop fastener area enables the elastic strap 128 with hook and loop fastener 130 to releasably close the front pocket 32 to releasably retain ballistic plate 34 within the front pocket.

The rear portion 14 has a rear wall/back panel 54 having an exterior 56, an interior compartment/storage area 58, a top 60, a bottom/pouch lower edge 62, a right side wall/peripheral side wall panel 64, and a left side wall/peripheral side wall panel 66. The right and left side walls extend about a periphery of the rear wall. A rear zipper half 68 extends around the right side wall, top, and left side wall to the bottom/flap lower edge 24 of the front wall panel/closure flap 16 to match the front zipper half 30. The bottom of the rear portion is permanently connected to the bottom 164 of the front portion 12 by a bottom wall 126. A right zipper pull 70 and a left zipper pull 72 releasably connect the front zipper half to the rear zipper half to releasably secure the ballistic backpack 10 in the folded condition/stowed position illustrated in FIGS. 3-9.

The interior 58 of the rear wall 54 includes a rear pocket/carrier 74 having a bottom end 138 that receives a ballistic plate/panel element 76. The ballistic plate is sewn (stitch line 144) in the rear pocket to connect the ballistic plate to the rear wall and is held securely by an elastic strap 132 with a hook and loop fastener 134 on the end so the ballistic plate can be removed and replaced. A portion of the rear pocket is covered by a standard Modular Lightweight Load-carrying Equipment (MOLLE) webbing system 80. The MOLLE system can be used to secure any desired compatible item, such as the magazine pouch 82 shown in FIGS. 2 and 2A, so the item will not fall out of the ballistic backpack when the ballistic backpack is in the deployed position. In the current embodiment, the MOLLE system uses 1.5" straps. A weapon clip retainer 84 is attached to the interior of the rear wall just below the top 60. The right and left side walls 64, 66 are connected to the front wall panel/closure flap 16 when the closure flap is in the stowed position, such that the right and left side walls encompass a compartment/storage area 58 between the rear and front ballistic plates/first and second ballistic panels 76, 34.

In the current embodiment, the front and rear ballistic plates 34, 76 are 10"×12" flat plates. The front and rear ballistic plates weigh less than 2 pounds and will stop multiple hits from an AK47 rifle, 0.223 rifle, handguns, and edged weapons. The front wall panel/closure flap 16 is movable between a closed/stowed position in which the closure flap extends up from the pouch lower edge 62 and encloses the pouch, and a deployed position in which the closure flap depends downward from the pouch lower edge. The rear ballistic plate has a bottom/first panel edge 88 that is proximate the lower pouch edge. The flap lower edge 24 is at a level above the pouch lower edge, such that when the closure flap is in the deployed position, the rear and front ballistic plates/first and second ballistic panels overlap. The front and rear ballistic plates are sized, and the front and rear pockets 32, 74 are positioned, such that the front ballistic plate is connected to the rear ballistic plate at a connection location spaced above the bottom/lower portion 88 of the rear ballistic plate to ensure the bottom 86 of the front ballistic plate overlaps the bottom of the rear ballistic plate by at least 2" (denoted by the double-headed arrow 160 in FIGS. 2 and 2A) when in the deployed position. The bottom/lower portion of the rear ballistic plate is connected to the bottom/first edge of the front ballistic plate by the bottom wall 126 so the front ballistic plate has a folding relation to the rear ballistic plate. The front ballistic plate depends downward from the rear ballistic plate in the deployed position. The top 90 of the rear ballistic plate has the top corners 92 clipped into a "shooter's cut" to enable more natural buttstock placement of a rifle and articulation of the wearer's arms and shoulders. The top 94 of the front ballistic plate is a straight edge. The front pocket and front ballistic plate in combination can be considered to be a front ballistic panel that includes a carrier directly attached to the pouch and defining an enclosure receiving a ballistic panel element. The top 22 of the front wall 16 includes a quick release tab 96. The quick release tab is a 5½" nylon strap sewn to the interior 20 of the front wall. The top 60 of the rear wall 54 includes a 2" carrying handle 98.

FIGS. 3-9 illustrate the improved ballistic backpack 10 of the present invention. More particularly, the ballistic backpack is shown in the folded condition/stowed position serving as a conventional backpack. The exterior 56 of the rear wall 54 includes a right shoulder strap 100 and a left shoulder strap 102. The right shoulder strap has a right length adjustment buckle 104, and the left shoulder strap has a left length adjustment buckle 106. In the current embodiment, the left and right shoulder straps are each 2" wide. A portion of the exterior of the rear wall is covered by a padding area 108. In the stowed position, the rear ballistic plate 76 overlays the front ballistic plate 34.

The left side wall 66 includes a left water bottle pocket 110 having a top 112 and a bottom 114. An elastic band 116 in the top of the left water bottle pocket releasably secures a water bottle (not shown) within the left water bottle pocket. The right side wall 64 includes a right water bottle pocket 118 having a top 120 and a bottom 122. An elastic band 124 in the top of the right water bottle pocket releasably secures a water bottle (not shown) within the right water bottle pocket.

Figure 9:
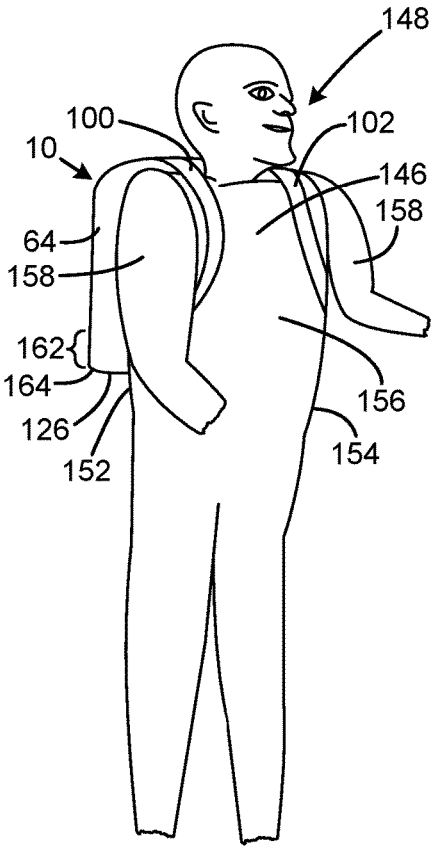
FIG. 9 is an isometric view of the ballistic backpack of FIG. 1 in use being worn on a wearer's back in the folded condition.

In the absence of a threat, the ballistic backpack 10 is worn on the wearer's back in the stowed position as a conventional backpack with the wearer's arms through the shoulder straps 100, 102 as depicted in FIG. 9. In the stowed position, the ballistic backpack resembles a conventional backpack, thereby concealing the ballistic backpack's ballistic protection capabilities from an observer (not shown).

Figure 10:
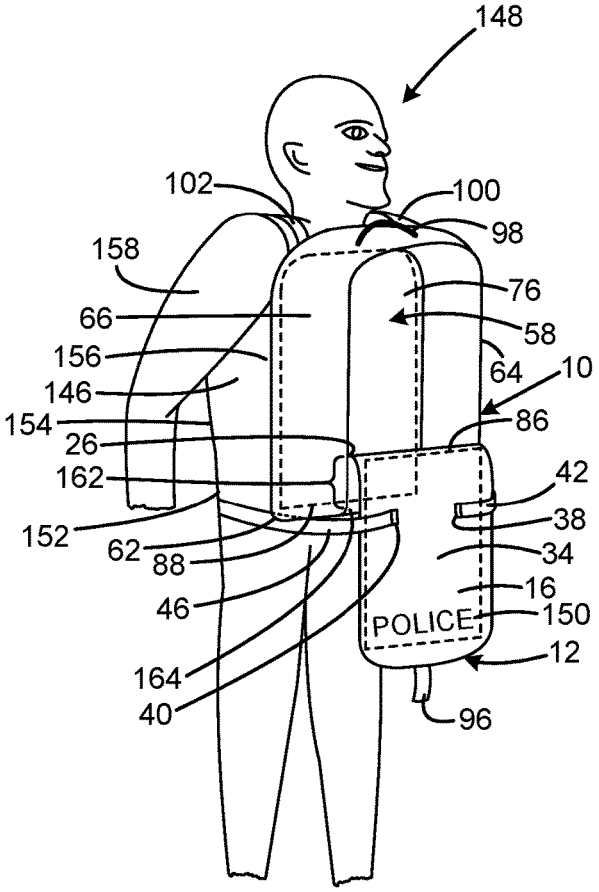
FIG. 10 is an isometric view of the ballistic backpack of FIG. 1 in use being worn on a wearer's front in the unfolded condition.

To transition the ballistic backpack 10 from the stowed position shown in FIG. 9 to the deployed position shown in FIG. 10 when a threat is present, the wearer 148 removes the ballistic backpack from his or her back 152 and places the ballistic backpack on the front 156 of his or her torso 146 by placing his or her arms 158 through the shoulder straps 100, 102. Then, the wearer pulls the quick release tab 96 downward, which causes the right and left zipper pulls 70, 72 to travel down the front and rear zipper halves 30, 68. The quick release tab is then released so the front side wall falls straight down in front of the wearer with the bottom 86 of the front ballistic plate 34 overlapping the bottom 88 of the rear ballistic plate 76 to prevent an uncovered seam area from occurring between the front and rear ballistic plates. The wearer can then withdraw the right and left waist straps 42, 46 and buckle the straps at his or her back 152 to releasably secure the front wall in place. While the ballistic backpack is in the deployed position, the first hook and loop fastener area 36, second hook and loop fastener area 52, MOLLE system 80, and weapon clip retainer 84 prevent attached items from falling out of the ballistic backpack and make the attached items readily accessible to the wearer.

In the current embodiment, the ballistic backpack 10 is constructed of 1000 denier nylon fabric for durability. The ballistic backpack is 17" tall, 12" wide, and 4" deep.

While a current embodiment of a ballistic backpack has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, instead of the two shoulder straps described, the backpack could have a single strap to enable use as a sling bag.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A ballistic backpack comprising:

a pouch having a back panel defining a compartment having a pouch lower edge;

shoulder straps connected to the pouch;

a closure flap connected to the compartment and having a flap lower edge connected to the pouch at the pouch lower edge;

the closure flap being movable between a closed position in which the closure flap extends up from the pouch lower edge and encloses the pouch, and a deployed position in which the closure flap depends downward from the pouch lower edge;

a first ballistic panel connected to the back panel and having a first panel edge proximate the lower pouch edge;

a second ballistic panel connected to the closure flap and having a second panel edge proximate the lower flap edge; and the flap lower edge being at a level above the pouch lower edge, such that when the closure flap is in the deployed position, the first and second ballistic panels overlap.

2. The ballistic backpack of claim 1 wherein the pouch includes a peripheral side wall panel extending about a periphery of the back panel and connected to the closure flap when the closure flap is in the closed position, such that the peripheral side wall encompasses a storage area between the first and second ballistic panels.

3. The ballistic backpack of claim 1 wherein the closure flap includes a waist strap adapted to encompass a wearer's body when the second ballistic panel is in the deployed position.

4. The ballistic backpack of claim 3 wherein the waist strap is stowed when not in use by retainers connected to the closure flap.

5. The ballistic backpack of claim 1 including a support facility adapted to support selected cargo between the first and second ballistic panels when in the closed position.

6. The ballistic backpack of claim 5 wherein the support facility is selected from the group consisting of hook and loop fasteners and Modular Lightweight Load-carrying Equipment (MOLLE) system straps.

7. The ballistic backpack of claim 1 wherein the second ballistic panel includes a carrier directly attached to the pouch and defining an enclosure receiving a ballistic panel element.

8. The ballistic backpack of claim 1 wherein the flap includes a pocket defining an enclosure receiving a ballistic panel element.

9. The ballistic backpack of claim 1 wherein the flap includes indicia displayed upright when the closure flap is in the deployed position.

10. A ballistic backpack comprising:

a pouch having a back panel defining a compartment having a pouch lower edge;

shoulder straps connected to the pouch;

a closure flap connected to the compartment and having a flap lower edge connected to the pouch;

a first ballistic panel connected to the back panel and having a lower portion;

a second ballistic panel having a first edge connected to the lower portion of the first ballistic panel; and the second ballistic panel having a folding relation to the first ballistic panel and movable between a stowed position in which the second ballistic panel at least partly overlays the first ballistic panel and a deployed position in which the second ballistic panel depends downward from the first ballistic panel.

11. The ballistic backpack of claim 10 wherein the first ballistic panel has a lower edge, and wherein the first edge of the second ballistic panel is connected to the first ballistic panel at a connection location spaced above the lower portion of the first ballistic panel such that the first and second ballistic panels overlap when in the deployed position.

12. The ballistic backpack of claim 10 wherein the second ballistic panel is connected to the closure flap.

13. The ballistic backpack of claim 10 wherein the second ballistic panel includes a waist strap adapted to encompass a wearer's body when the second ballistic panel is in the deployed position.

14. The ballistic backpack of claim 13 wherein the waist strap is stowed when not in use by retainers connected to the closure flap.

15. The ballistic backpack of claim 10 including a support facility adapted to support selected cargo between the first and second ballistic panels when in the stowed position.

16. The ballistic backpack of claim 15 wherein the support facility is selected from the group consisting of hook and loop fasteners and Modular Lightweight Load-carrying Equipment (MOLLE) system straps.

17. The ballistic backpack of claim 10 wherein the pouch defines an enclosure receiving a ballistic panel element.

* * * * *